US005304797A

United States Patent [19]

Irie et al.

[11] Patent Number: 5,304,797

[45] Date of Patent: Apr. 19, 1994

[54] GAS ANALYZER FOR DETERMINING IMPURITY CONCENTRATION OF HIGHLY-PURIFIED GAS

[75] Inventors: Takashi Irie, Kokubunji; Yasuhiro Mitsui, Fuchu; Keiji Hasumi, Iruma, all of Japan

[73] Assignees: Hitachi, Ltd.; Hitachi Tokyo Electronics, Co., Ltd., Tokyo, Japan

[21] Appl. No.: 16,534

[22] Filed: Feb. 11, 1993

[30] Foreign Application Priority Data

Feb. 27, 1992 [JP] Japan ..... 4-041330

[51] Int. Cl.[5] ..... H01J 49/40

[52] U.S. Cl. ..... 250/287; 250/282

[58] Field of Search ..... 250/287, 286, 282

[56] References Cited

U.S. PATENT DOCUMENTS 3,626,180 12/1971 Carroll et al. ..... 250/287
3,699,333 10/1972 Cohen et al. ..... 250/287
5,053,343 10/1991 Vora et al. ..... 250/287

OTHER PUBLICATIONS

Ametek 5700 Moisture Analyzer.

Ultra-Clean Technology, vol. 1, No. 2, pp. 41-42.

"An Analysis for Gases with APIMS", Ultra-Clean Technology, vol. 1, No. 1, pp. 13-21, 1990.

"Determination of Trace Impurities in Highly Purified Nitrogen Gas by Atmospheric Pressure Ionization Mass Spectrometry", Analytical Chemistry, vol. 55, No. 3, pp. 477-481, 1983.

"Plasma Chromatography", Analytical Chemistry, vol. 46, No. 8, pp. 710A-720A, Jul. 1974.

*Primary Examiner*—Jack I. Berman

*Attorney, Agent, or Firm*—Fay, Sharpe, Beall, Fagan, Minnich & McKee

[57] ABSTRACT

Ultra-low concentrations of impurities such as water in a highly-purified gas are analyzed by a system having an ion source chamber and a drift chamber. The ion source chamber ionizes one of a sample gas and a carrier gas to produce main component ions, and the other of the sample gas and carrier gas is introduced into the drift chamber. The invention controls the residence time of main component ions in one of the first and second chambers to be shorter than the mean reaction time of main component ions and impurity molecules of the sample gas in the one of the first and second chambers.

22 Claims, 8 Drawing Sheets

GAS ANALYZER FOR DETERMINING IMPURITY CONCENTRATION OF HIGHLY-PURIFIED GAS

BACKGROUND OF THE INVENTION

1. Field of the Invention

The present invention relates to a gas analyzer, and, more particularly, to a system for analyzing an impurity of ultra-low concentration, such as water, in a highly-purified gas.

2. Description of the Related Art

Known gas analyzers for analyzing an impurity of ultra-low concentration (for example, on the parts-per-billion, or ppb, level) include a dew-point meter, an atmospheric pressure ionization mass spectrometer (APIMS) and a plasma chromatography system. Such systems are especially useful when analyzing the water content of a purified gas.

Known dew-point meters are based upon detection of the frequency deviation of a quartz oscillator having an adsorbed water content, or the optical detection of moisture drops that have condensed on a mirrored surface. An example of the former type of dew-point meter is the AMETEK 5700 Moisture Analyzer; an example of the latter is disclosed on pages 41–42 of *Ultra-Clean Technology,* Vol. 1, No. 2.

Conventional dew-point meters are slow to respond to the change in dew point with respect to a change in moisture concentration at the ppb level (e.g., about −80° C. at a freezing point), and thus cannot perform real-time analysis. See, for example, pages 13–21 of *Ultra-Clean Technology,* Vol. 1, No. 1. Further, the conventional dew-point meter system is large because it requires a helium refrigerator, as described in *Ultra-Clean Technology,* Vol. 1, No. 2, pages 41–42.

The conventional APIMS is highly sensitive, having an impurity detection limit of 1 part-per-trillion, or ppt (i.e., $1/10^{12}$), for a highly-purified gas. It can measure not only water content, but also such varied substances as oxygen and organic components simultaneously in real time. An example of an APIMS is disclosed in *Analytical Chemistry,* Vol. 55, No. 3, pages 477–481.

The conventional APIMS cannot be practically arranged in a plurality of measurement sites in a clean room due to its requirement for differential pumping using a vacuum pump of large displacement. Further, it is difficult to simultaneously monitor the gas purity at various points of the gas supply system.

In the conventional plasma chromatography apparatus, a sample gas is ionized and fed to a drift tube where ions of different species are separated in accordance with the time difference required for the ions to move in the gas in the drift tube under an electric field. In order to analyze a highly-purified gas, the difference between the mobility of main component ions produced by the ionization means and the mobility of impurity ions produced by reaction of the main component ions and the impurity molecules is used to separate the main component ions from the impurity ions in the drift tube. Then, the impurity concentration can be measured from the detected intensity of the impurity ions. This gas analyzer is relatively small in size, and economical, requiring neither a vacuum pump nor a refrigeration system. An example of a plasma chromatography apparatus is disclosed in *Analytical Chemistry,* Vol. 46, No. 8, pages 710A–720A.

Known plasma chromatography systems have been utilized for analysis of organic components, but not for analysis of water content. More particularly, because the moisture of the carrier gas is subjected to an ionization reaction with organic substances of the impurity, thus acting as a main component ion, the conventional plasma chromatography system does not analyze water content. Moreover, conventional plasma chromatography systems have been incapable of analyzing ultra-low concentrations of water in the highly-purified carrier gas because no consideration has been given to modifying the ion production mechanism in the ion source and in the drift tube, the drift distance, the value of the drift voltage, and the gas purity in the drift tube.

SUMMARY OF THE INVENTION

The present invention has been devised to overcome the problems of the prior art to accurately analyze ultra-low concentrations of impurities such as water in a highly purified gas used in the fabrication of semiconductors, for example. As such, the present invention can be arranged in multiplicity in a clean room to continuously perform analyses and measurements in real time.

In conjunction with these objectives, the present invention is small in size and can be mounted directly at a number of metering points of a high-purified gas supply system in a clean room, and can evaluate the purity of the gas continuously and in real time throughout the supply system.

The inventive gas analyzer includes an ion source having a first chamber in which the sample gas is ionized. A second chamber separates the ionized species of the ionized gas. Signal processing means are provided for detecting and analyzing the separated ions.

In a particular embodiment of the invention, the residence time of the main component ions in the second chamber is controlled to be shorter than the mean reaction time of the main component ions and the impurity molecules in the second chamber.

In another embodiment, the sample gas is introduced into the second chamber, and the residence time of the main component ions in the first chamber is controlled to be shorter than the reaction time of the main component ions and the impurity molecules in the first chamber.

In both embodiments, at least one of the ion source and the ion species separating means is equipped with control means for controlling the residence time of the ions as stated. The control means varies at least one of the voltages of a plurality of electrodes provided for generating an electric field, or by varying the distance between the electrodes, or both.

DETAILED DESCRIPTION OF THE PREFERRED EMBODIMENTS

Figure 1:
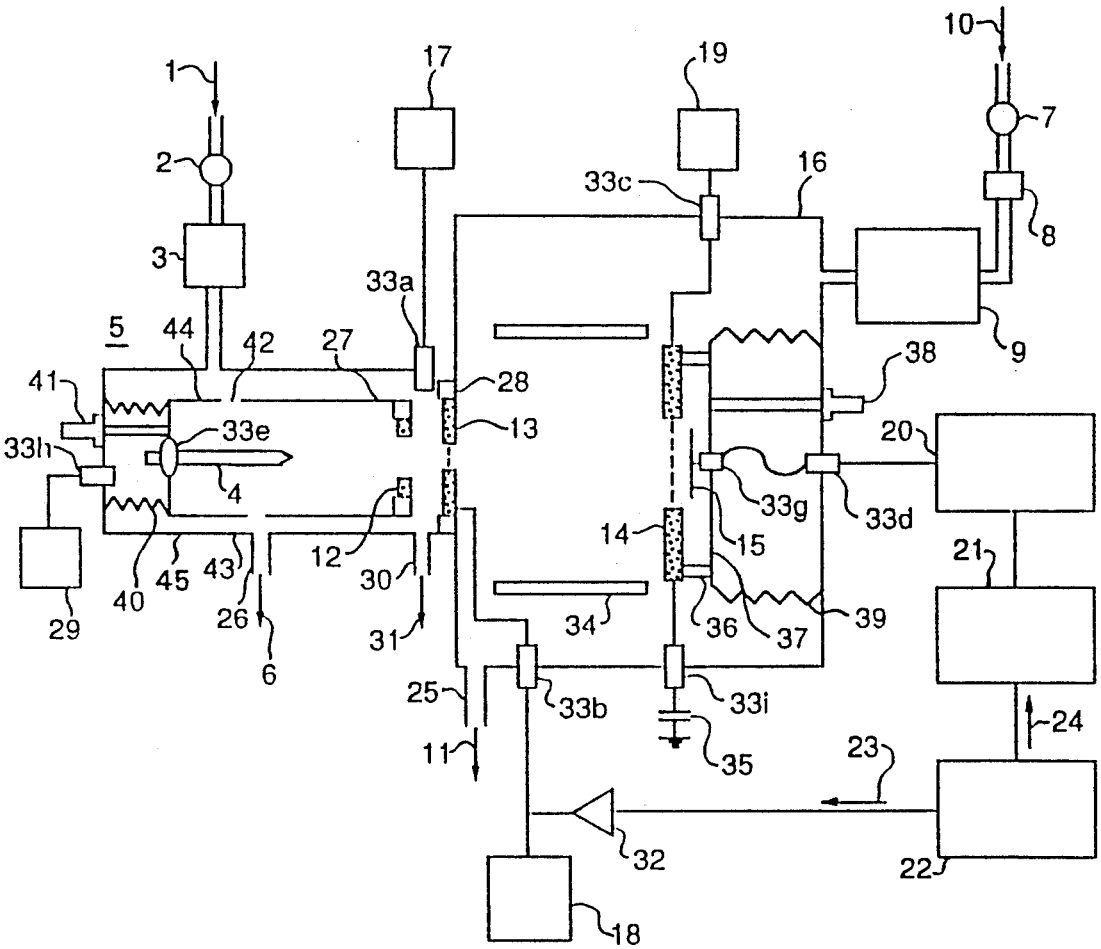
FIG. 1 is a block diagram showing the construction of a first embodiment of the gas analyzer according to the present invention.

In a first embodiment, for example as shown in FIG. 1, a sample gas 1 to be analyzed is introduced into the ion source 5. The sample gas (illustratively having a main component C, and trace impurity X) is subjected to primary ionization by an ionization means to produce main component ions {C+} and impurity ions {X+}. Of the ions thus produced in the primary ionization process, the amount of the impurity ions {X+} can be ignored at the ppb level.

In the ion source 5, the impurity ions {X+} are produced through a secondary ionization by reaction between the main component ions {C+} and the impurity molecules X. This ion mixture is introduced into a second chamber of the ion species separating means, and is drifted by an applied electric field so that the constituent ions are separated in accordance with their respective mobility differences.

Accordingly, the concentration [X] of the impurity X in the sample gas 1 is determined in the following manner when the ion intensity of the ions {C+} is not decreased in the second chamber.

If a reaction rate constant of {C+}+X→C+{X+} is designated as k, the production rate for {X+} ions in the ion source 5 is expressed by:

$$d[\{X+\}]/dt = k[X][\{C+\}] \quad (1).$$

Here, [{X+}] and [{C+}] designate the concentrations of {X+} and {C+}.

For the reaction {C+}+X→C+{X+}, the increase of the ions {X+} is equal to the decrease in the ions {C+}, as follows:

$$d[\{X+\}]/dt = -d[\{C+\}]/dt.$$

Hence, Equation (1) can be rewritten:

$$d[\{C+\}]/dt = -k[X][\{C+\}] \quad (2).$$

If the residence time of the ions in the ion source 5 is designated as $t_0$, the concentration [{C+}] of the ions {C+} when the ions are introduced into the second chamber is expressed by:

$$[\{C+\}]_1 = [\{C+\}]_0 \exp(-kt_0[X]) \quad (3).$$

Here, $[\{C+\}]_0$ indicates the concentration of the ions {C+} immediately after ionization, and is equal to the total ion intensity when an impurity concentration in the ppb range is considered.

Since the ions partially scatter while moving in the second chamber, the ion intensity decreases. However, the effect of the ion scatter is substantially identical for the main component ions {C+} and the impurity ions {X+}. If the total measured ion intensity is designated as $I_t$, and if the ion intensity of the ions {C+} is designated as I, then $I/I_t$ equals $[\{C+\}]_1/[\{C+\}]_0$. In case the ions {C+} and {X+} can be separated by the ion species separating means, the impurity concentration [X] can be determined from:

$$[X] = (1/(kt_0))\ln(I_t/I) \quad (4)$$

To measure the impurity concentration from the intensity of the unreacted main component ions {C+}, as described above, it is important to determine the conditions of the system so that the unreacted ions {C+} can be measured. Specifically, in Equation (3), for expressing the changing rate of the intensity of the ions {C+}, the term 1/(k[X]) implies the mean reaction time (or the mean lifetime of the ions {C+}) between the ions {C+} and the impurity X. It is important that the ion residence time $t_0$ be as short as or shorter than the mean reaction time. In other words, it is important to determine the measurable range of the concentration of the impurity X.

If the relative ion intensity ($I/I_t$) of the ions {C+} at the limit for determining the presence of the impurity ions {X+} from the spectrum is designated as $\beta(0<\beta<1)$, then $I/I_t>\beta$ holds. That is, from Equation (4):

$$[X] < (1/(kt_0))\ln(1/\beta) \quad (5).$$

In other words, the upper limit for measurable concentration of [X] is expressed by $(1/(kt_0))\ln(1/\beta)$.

Since the value k is a constant, the measurable concentration range is determined in terms of the residence time $t_0$. Thus, the value of the residence time $t_0$ is determined by the control means in accordance with the range of the impurity concentration to be measured.

In the present embodiment, the ion-molecule reaction for reducing the ion intensity of the main component ions {C+} does not take place in the second chamber (i.e., the drift tube 15). However, the impurity in the drift gas cannot be completely eliminated; instead, the main component ions {C+} are reduced by the reaction between the main component ions {C+} and an impurity Y present in the drift area.

The intensity change of the main component ions {C+} by the reaction between the main component ions and the impurity Y (having a reaction rate constant k') in the second chamber is expressed, like Equation (3), by:

$$[\{C+\}]_2 = [\{C+\}]_1 \exp(-k't_1[Y]) \quad (6).$$

Here, $[\{C+\}]_1$, $t_1$ and [Y] respectively designate the concentration of the ions {C+} when introduced into the drift tube 16, the drift time of the ions {C+} and the impurity concentration in the drift gas.

Thus, even if the sample gas 1 introduced into the ion source 5 has no impurity, that is, if [X]=0 (i.e., $[\{C+\}]_1=[\{C+\}]_0$ in Equation (3)), the value $I/I_t$ obtained will not exceed the value $[\{C+\}]_2/[\{C+\}]_1$ determined from Equation (6). In other words, $I/I_t$ is less than $\exp(-kt_1[Y])$. Hence, from Equation (4):

$$[X] > k't_1[Y]/(kt_0) \quad (7).$$

From Equations (5) and (7):

$$k't_1[Y]/(kt_0)<[X]<(1/kt_0))\ln(1/\beta) \quad (8).$$

In order to measure the impurity concentration [X], therefore, the following relation must hold:

$$k't_1[Y]/(kt_0)<(1/kt_0))\ln(1/\beta);$$

that is, $$t_1<(1/(k'[Y]))\ln(1/\beta).$$

As shown by Equation (6), the term $1/(k'[Y])$ implies the mean time (or the mean lifetime of the ions $\{C+\}$) of the reaction between the impurity Y in the gas introduced into the drift tube 16 and the ions $\{C+\}$, and the term $\ln(1/\beta)$ takes a value of about 1. Hence, the drift time $t_1$ of the ions $\{C+\}$ must be shorter than the mean time for the reaction of the main component ions with the impurity Y.

Figure 3:
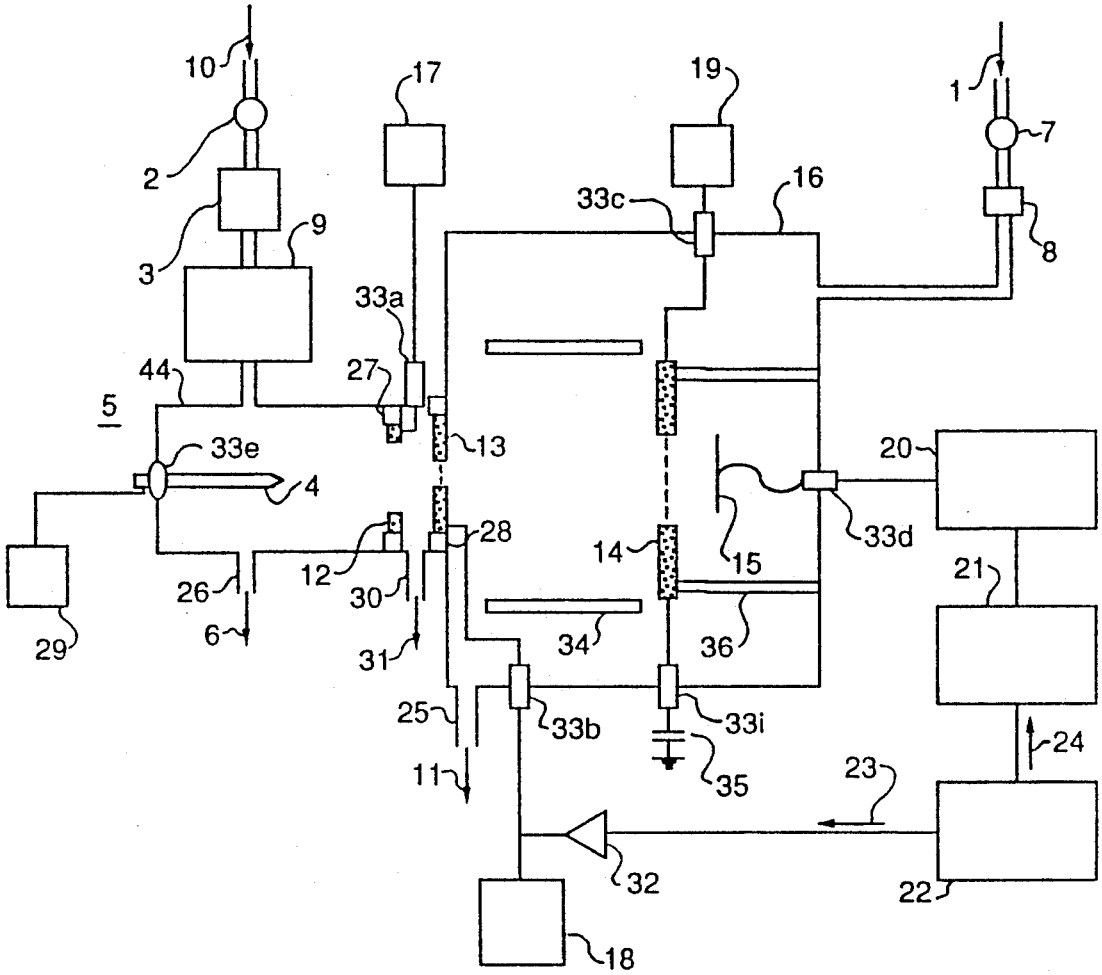
FIG. 3 is a block diagram showing the construction of a third embodiment of the gas analyzer according to the present invention.

In another embodiment, shown in FIG. 3, for example, the sample gas 1 to be analyzed is introduced into the ion species separating means (second chamber). Thus, the carrier gas is introduced into the ion source 5.

When the carrier gas, having an impurity concentration [Y], is highly purified by a purification means, the main component ions $\{C+\}$ are produced in the ion source to cause the ion-molecule reaction between the ions $\{C+\}$ and the impurity X to take place in the drift tube 16. The changes in the intensity of the main component ions $\{C+\}$ in the ion source and in the drift tube 16 in this embodiment are thus expressed by the following equations, which are similar to Equations (3) and (6) of the first embodiment described previously:

$$[\{C+\}]_1=[\{C+\}]_0 \exp(-k't_0[Y]) \quad (3');$$

and $$[\{C+\}]_2=[(C+\}]_1 \exp(-kt_1[X]) \quad (6')$$

The measurable range of the impurity concentration [X] in this case is expressed by:

$$k't_0[Y]/kt_1<[X]<(1/(kt_1))\ln(1/\beta),$$

because $\beta<I/I_t<\exp(-kt_0[Y])$ and $I/I_t=\exp(-kt_1[X])$.

In order to measure the ions [X], therefore, the following reaction must hold:

$$t_0<(1/(k'[Y]))\ln(1/\beta).$$

Hence, the residence time $t_0$ for the main component ions to reside in the ion source 5 must be controlled to be shorter than the mean reaction time $1/(k'[Y])$ between the main component ions $\{C+\}$ and the impurity Y.

Thus, as previously mentioned, it is important to control the impurity concentration in the gas and the ion residence time in the ion source 5 and in the drift tube 16.

The foregoing concepts will be better understood in conjunction with the following specific embodiments.

EMBODIMENT 1

FIG. 1 is a schematic illustration of a gas analyzer constructed according to the teachings of the present invention. By way of example, the embodiments shown in FIG. 1 may be used for analyzing a trace water content of a nitrogen gas.

The major components of the embodiments shown in FIG. 1 include an ion source 5 for ionizing a sample gas 1 to be analyzed; a drift tube 16 for drifting the ionized gas; a detector 15 for detecting the ions separated in drift tube 16; and a signal processor 21 for amplifying and analyzing the signal from detector 15 using a current amplifier 20.

Illustratively, ion source 5 includes a cylindrical housing 45 having a first cylindrical chamber 44, a pressure regulator 2 and a flow controller 3 for controlling the introduction of sample gas 1 into chamber 44. Ion source 5 and drift tube 16 are constructed to have apertures for passing ions therethrough, and are spatially isolated by electrode, or shutter, 13, which is electrically isolated from drift tube 16 and cylindrical housing 45 by an insulator 28.

Chamber 44 includes an inlet 42 for introducing the sample gas 1 through flow controller 3, an outlet 43 for discharging excess gas, and an ionization unit 4 for ionizing the gas introduced into chamber 44. Excess sample gas is discharged as discharge gases 6 and 31 from outlets 26 and 30, respectively, of housing 45.

In the present embodiment, the ionization means is exemplified by a needle electrode 4, which establishes a corona discharge by virtue of a high voltage supplied from power source 29 to the needle electrode 4 via feedthroughs **33*e* and 33*h***. However, the ionization means should not be construed as being limited to a corona discharge means, but may comprise a radiation source, laser or any other known and suitable ionization means.

The isolation between ion source 5 and drift tube 16 should prevent, as much as possible, the mixing of sample gas 1 and purified gas 10, which is introduced into drift tube 16 in this embodiment. Electrode 13, constituting the shutter of the drift tube 16, carries a dual function to reduce the size and complexity of the apparatus construction. Thus, shutter 13 may be of the Tyndall type, composed of one set of two electrodes having a metallic mesh mounted on their respective openings, or of the B-N type, composed of electrodes having metallic wires closely mounted at the respective openings, and alternately fed with an equal potential.

Adjacent drift tube 16, chamber 44 contains an ion extraction electrode 12 which is electrically isolated from chamber 44 by an insulator 27. Ion extraction electrode 12 includes an aperture through which ions can pass. Drift tube 16 is constructed so that electrode 14 and detector 15 are arranged, in that order, from ion source 5.

Thus, the ion extraction electrode 12, shutter 13 and electrode 14 are fed with a high voltage through feedthroughs **33*a*, 33*b* and 33*c*, respectively, from power sources 17, 18 and 19** to generate an electric field necessary for drifting the ions.

The purified gas 10 is pressure-regulated by pressure regulator 7, and flow rate-controlled by flow controller 8. Before being introduced into drift tube 16, the gas is purified by purifier 9 to reduce impurities to about 1 ppb by using a molecular sieve trap or a liquid nitrogen trap as purifier 9. The purified gas 10 is discarded at 11 from an outlet 25 after passing through drift tube 16.

To control the residence time of the ions in chamber 44 and in drift tube 16, the present embodiment includes a means for controlling the distance between electrode 12 and shutter 13, and the distance between shutter 13 and electrode 14.

To achieve this objective, the ion source 5 is constructed so that needle electrode 4 and ion extraction electrode 12 are integrated with chamber 44. Chamber 44 is, in turn, coupled to housing 45 by distance varying means 40, which may be a bellows or spring, and which is preferably operated by a linear-motion feedthrough 41. Since needle electrode 4 and ion extraction electrode 12 are so integrated, the residence time of the ions in chamber 44 can be controlled by varying the distance between the electrode 12 and shutter 13 while maintaining a fixed distance between needle electrode 4 and ion extraction electrode 12.

Since the state of corona discharge depends upon the distance between needle electrode 4 and ion extraction electrode 12, the residence time of the ions in the ion source 5 (i.e., in chamber 44) can be controlled without being influenced by the state of the corona discharge.

In a similar fashion, electrode 14 and jig 37 are integrated through an insulator 36, and detector 15 and jig 37 are integrated with drift tube 16 via feedthrough 33g. Jig 37 is coupled to the drift tube housing by distance varying means 39 so that the position of jig 37 is varied by linear motion feedthrough 38.

Thus, since electrode 14, detector 15 and jig 37 are fixed with respect to each other, the drift distance between electrode 14 and shutter 13 can be varied while maintaining the positional relationship between electrode 14 and detector 15, to thus control the drift time (i.e., the time period for the ions to arrive, or the residence time for the ions in drift tube 16).

Since the residence time of the ions is proportional to the distance through which the ions move, and inversely proportional to the potential difference between the relevant electrodes, a high voltage has been required to shorten the residence time when the drift distance is maintained constant. According to the present embodiment, however, the residence time is controlled by using the distance varying means 39 and 40 so that the high voltage power sources 17, 18 and 29 need not be modified for this purpose.

As has been described in connection with Equation (8), the drift time of the main component ions $\{C+\}$ must be shorter than the mean time of reaction of the ions $\{C+\}$ with the impurity in the drift tube 16. Assuming that the total concentration of all impurities in the highly purified gas 10 is about 1 ppb, if $[Y]=2.7\times10^{10}$ molecules/cm$^3$ (1 ppb) and if $\beta=0.1$, then $t_1[Y]/t_0[X]<[X]<100/t_0$ (where concentration is measured in ppb, and $t_0$ and $t_1$ in ms), because the following equation usually holds: $k=k'=1/10^9$ cm$^3$/molecules·s.

Accordingly, for example, in order to achieve a lower limit of detection that is no greater than 1 ppb, it is necessary that $t_1[Y]/t_0<1$, i.e., $t_1<t_0$. In order to achieve a measurable upper limit of no more than 100 ppb, it is necessary that $100/t_0>100$, i.e., $t_0<1$ ms. It is therefore necessary to make an adjustment satisfying $t_1<1$ ms under the conditions that the impurity concentration [Y] in the drift gas 16 be about 1 ppb. This condition that the measurable range fall between 1 ppb and 100 ppb is especially advantageous for micro-moisture analysis of highly purified gases such as nitrogen or argon, because this range cannot be measured using the conventional dew-point meter.

Here, the conditions for $t_1<1$ ms and $t_0<1$ ms correspond to the case in which the reaction rate constant $k=k'=1/10^9$ cm$^3$/molecules·s, as noted above. For an impurity having a small rate constant, the equivalent measurable range can be achieved even if both $t_1$ and $t_0$ exceed 1 ms.

In order that the ions $\{C+\}$ and $\{X+\}$ may be separated in the drift tube 16, moreover, the time resolution (i.e., the ratio of the time (half) width of the spectrum to the drift time $t_0$) should be at least 3%. Hence, the time width (or pulse width) for inputting ions into drift tube 16 should be no more than one-thirtieth of the drift time $t_1$. At the same time, in order to retain ion intensity, the pulse width should be no less than about 10 μs. Thus, $t_1>0.3$ ms, so that the drift time satisfies 0.3 ms$<t_1<1$ ms.

Figure 8:
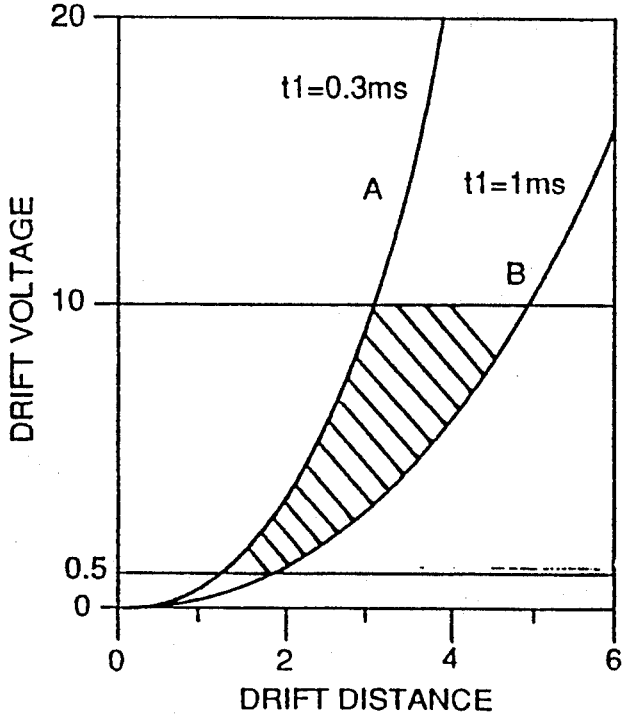
FIG. 8 is a diagram showing the relation between the electrode voltage and the drift distance.

If the drift time $t_1$ is expressed by $L^2/K\cdot V$ (where L is the drift distance, K is the mobility and V is the drift voltage), and if the mobility K has a value of about 2 cm$^2$/V·s (true for nitrogen gas), the values L and V must meet the conditions defined by curves A and B in FIG. 8.

Moreover, the theoretical value of time revolution of drift tube 16 is determined by the diffusion in the gas of the ions, and is expressed by $\sqrt{(16\cdot\ln 2\cdot D/K\cdot V)}$, and the relation of the drive voltage $V>0.5$ kV is necessary for the stated time resolution of 3%. In this case, the diffusion coefficient V and the mobility K have values of about 0.06 cm$^2$/s and 2 cm$^2$/V·s, respectively (for nitrogen gas). Moreover, a maximum drift voltage of 10 kV is practical in view of the breakdown property of the drift tube 16.

Under these conditions, the system operates in accordance with the hatched section shown in the graph of FIG. 8. For nitrogen gas, therefore, it is important to establish $1<L<4$ cm and $0.5<V<10$ kV. Typical system conditions include a drift voltage of 5 kV, a drift distance of 2.5 cm, and an impurity concentration in the drift gas of 1 ppb. If a purification as great as 0.1 ppb is obtained, the conditions of 0.3 ms$<t_1<10$ ms would be necessary for the impurity measurable range of 1 to 100 ppb for the sample gas. In this case, the range 1 cm$<L<40$ cm would be sufficient. Note that a different mobility K would require different values for L and V.

When more than one type of impurity constitutes "impurity X", and their respective mobilities are so similar that they cannot be separated in drift tube 16, their individual concentrations cannot be determined. For example, water ions and carbon dioxide ions have substantially equal mobilities of 2.1 cm$^2$/V·s.

However, nitrogen ions have a mobility of 2.3 cm$^2$/V·s; and they can thus be separated from water and carbon dioxide ions. Using Equation (4), then, the total concentration of the impurities can be determined.

Of course, the different impurity species will have different values of reaction rate constants k so that their concentrations will be difficult to precisely measure. However, since the major impurities in highly-purified gas are water, oxygen and carbon dioxide, which have, at most, a difference of about one order in reaction rate constant, the order analysis of the impurity concentrations can be obtained.

As an example of the present embodiment, the water content of a sample gas (of which the major component is nitrogen, for example) is analyzed in the following manner. While the ions reside in ion source 5, nitrogen ions $\{N_2+\}$ convert into $\{N_4+\}$ within an extremely short time (i.e., no longer than 1 μs) by the reaction $\{N_2+\}+2N_2\rightarrow\{N_4+\}+N_2$. These $\{N_4+\}$ ions are the main component ions.

Next, the ions $\{N_4+\}$ react with the water impurity as follows:

$$\{N_4+\}+H_2O\rightarrow\{H_2O+\}+2N_2 \quad (9);$$

$$\{H_2O+\}+2N_2\rightarrow\{N_2H_2O+\}+N_2 \quad (10)$$

$$\{N_2H_2O+\}+H_2O\rightarrow\{H_3O+\},\ (H_3OOH+\},\ (N_2H_3O+\} \quad (11)$$

and $$\{H_3O+\},\ \{H_3OOH+\},\ \{N_2H_3O+\}+H_2O+N_2\rightarrow\{H_3O(H_2O)_2+\} \quad (12)$$

Since reactions (10) and (12) are far faster than reactions (9) and (11), $\{H_2O+\}$ will change into $\{N_2H_2O+\}$ within an extremely short time (no longer than 1 μs); and $\{H_3O+\}$, $\{H_3OOH+\}$ and $\{N_2H_3O+\}$ will also change into $\{H_3O(H_2O)_2+\}$ within a short time. The resulting water ions are thus mainly $\{N_2H_2O+\}$ and $\{H_3O(H_2O)_2+\}$.

The nitrogen and water ions thus produced are extracted by the electric field generated by the high voltage applied to the ion extraction electrode 12 and shutter 13, and the residence time in the ion source 5, as previously discussed, is controlled by the intensity of that electric field and the distance between ion extraction electrode 12 and shutter 13.

The ion group that moves upstream of shutter 13 is pulsed by closing and opening shutter 13 over a short time period. The resulting pulse of mixed ions reaches detector 15 in accordance with the electric field generated by shutter 13, electrode 14 and detector 15, which is at ground potential. The drift time is controlled by controlling the distance between shutter 13 and electrode 14, and by controlling the voltage applied to each of shutter 13 and electrode 14. The resulting detected ion current is fed through a feedthrough 33*d* to amplifier 20.

When the distance between shutter 13 and electrode 14 is equal to or greater than the respective sizes of shutter 13 and electrode 14, a guard ring 34 may be included to enhance the uniformity of the electric field. Moreover, noise which might otherwise be induced by detector 15 by pulses applied in opening and closing shutter 13 can be reduced by mounting a metallic mesh on the opening of electrode 14 and by grounding electrode 14 through a capacitor 35.

On the other hand, the time period required for the ions to move between electrode 14 and detector 15 can be set to be far shorter than the time for the ions to pass through the drift region between shutter 13 and electrode 14. For example, if the distance between electrode 14 and detector 15 is 0.2 cm, and if the voltage to be applied to electrode 14 is 1 kV, the passage time is about 20 μs so that the drift time can be suppressed to within 2% of a standard value of about 1 ms.

In the pulse ion group in drift tube 16, there mainly exist the ions $\{N_4+\}$, $\{N_2H_2O+\}$ and $\{H_3O(H_2O)_2+\}$ which are produced in the ion source 5. These main components are observed separately in time because of their different respective mobilities, while moving from shutter 13 to detector 15. Since the mobility of $\{N_4+\}$ is 2.3 $cm^2/V\cdot s$, whereas $\{N_2H_2O+\}$ and $(H_3O(H_2O)_2+\}$ have substantially equal mobilities of 2.1 $cm^2/V\cdot s$, the main component nitrogen ions and the impurity water ions can be easily separated.

The ion current waveform (the output of amplifier 20) can be measured as the relationship between the arrival time of ions at the detector and the current intensity by using signal processor 21, which is triggered by a trigger signal 24 synchronized with a shutter operating signal 23 fed from the signal generator 22 that operates shutter 13. Preferably, the shutter operating signal 23 is applied to shutter 13 via a DC voltage insulating means 32 (such as a photocoupler) due to the high voltage being applied to shutter 13.

Figure 7:
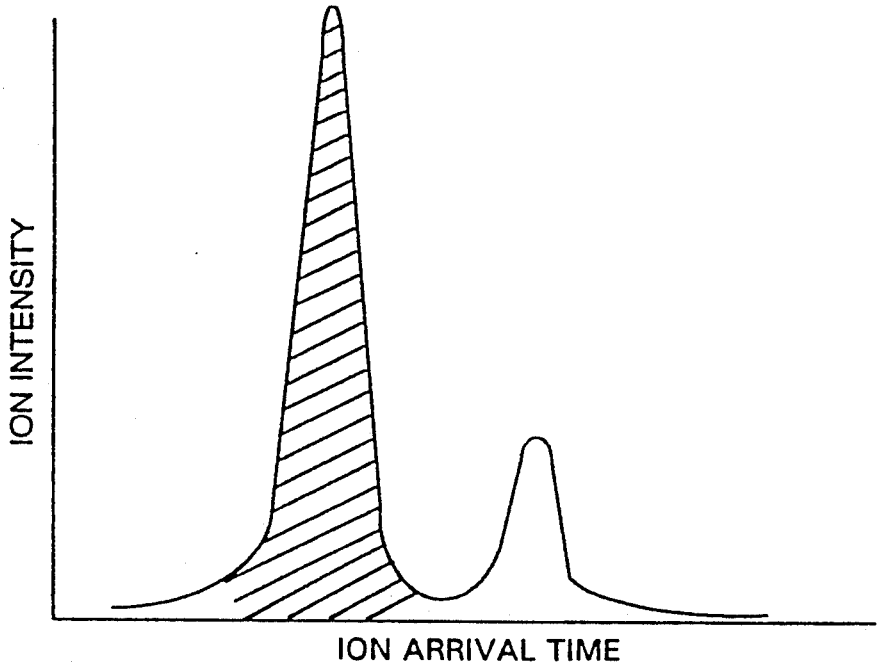
FIG. 7 is a spectral diagram obtained from one embodiment of the gas analyzer according to the present invention.

FIG. 7 is a spectral diagram showing one example of the relationship between the ion arrival time and the current intensity obtained by detector 15. Signal processor 21 determines the ratio (the relative ion density) $I/I_t$ ion intensity (hatched in FIG. 7) of the main component $\{N_4+\}$ to the total ion intensity (the total area of the portion defined by curves A and the abscissa) from the spectrum to determine the water concentration on the basis of the equations recited above. Since an accurate measurement of $t_0$ is difficult, and since the values of the reaction rate constant k are not precisely known, it is necessary in quantitative analysis to determine the relationship between the ions [X] and the ratio $I/I_t$ experimentally in advance by using a standard gas containing a known impurity [X] of known concentration under identical system conditions.

EMBODIMENT 2

Figure 2:
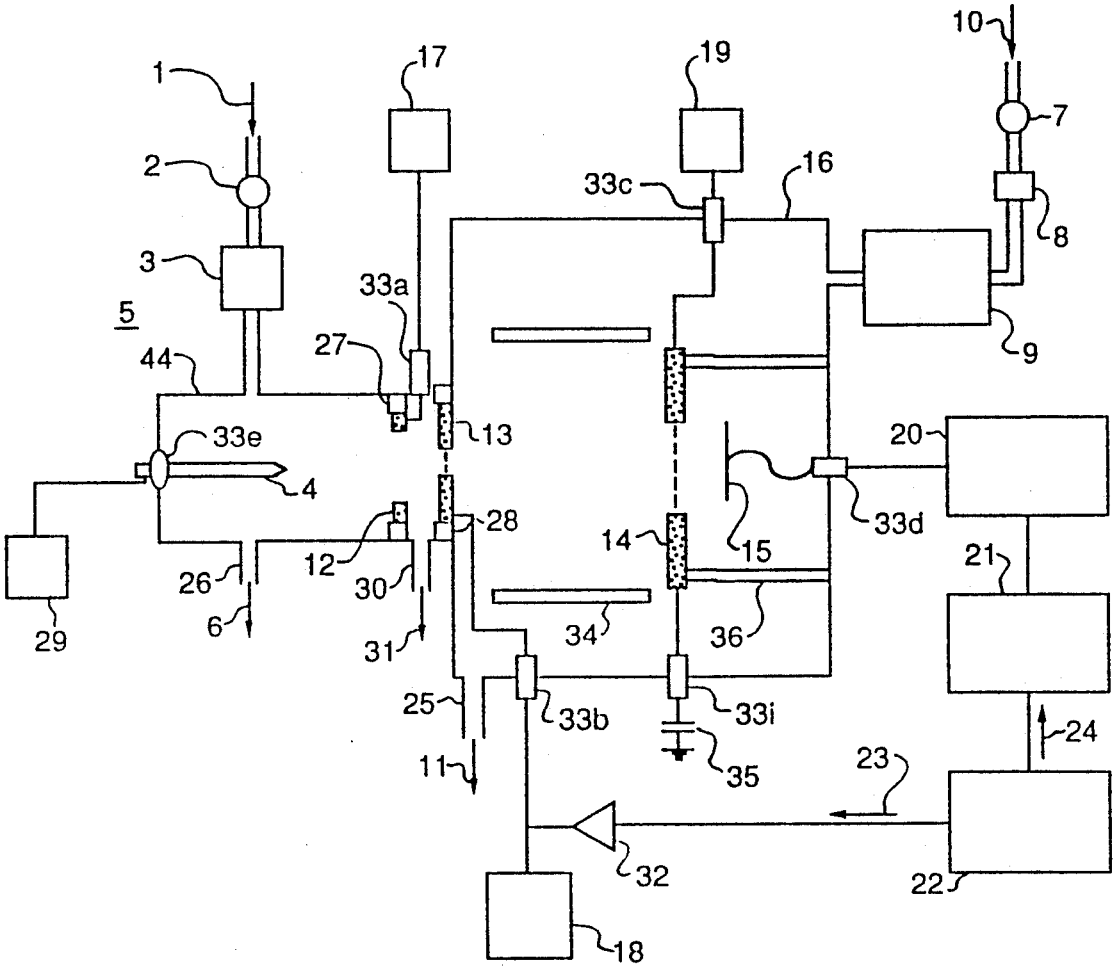
FIG. 2 is a block diagram showing the construction of a second embodiment of the gas analyzer according to the present invention.

FIG. 2 is a block diagram of a second embodiment of the gas analyzer constructed according to the teachings of the present invention. Those portions of the FIG. 2 diagram having the same functions as those of the embodiments shown in FIG. 1 are designated by similar reference numerals, and their description will be omitted below.

For a determinate analysis target and measurable range (for example, a water content of 1 ppb to 100 ppb in nitrogen gas), the distance varying means of FIG. 1 can be eliminated to simplify the system. In the present embodiment, electrodes 12 and 14 are coupled through insulators 27 and 33, respectively, to directly connect the housing of the ion source 5 and the drift tube 16.

Thus, for an ion extraction electrode 12-shutter 13 spacing of 1 cm, and an electric field intensity of 1 kV/cm, the residence time between ion extraction electrode 12 and shutter 13 is about 0.5 ms because the ion mobility is about 2 $cm^2/V\cdot s$. Thus, for a corona discharge ionization, approximately 0.1 ms elapses before ions are extracted. The total ion residence time in ion source 5 is then about 0.6 ms.

The upper limit of the water content measurement in this instance is determined to be about 70 ppb by setting $t_0=0.6$ ms, $\beta=0.1$ and $k=2\times10^9$ $cm^3$/molecules·s using Equation (8). For a drift distance (i.e., between shutter 13 and electrode 14) of 2.4 cm and a drift voltage (between shutter 13 and electrode 14) of 3.6 kV, the ion drift time is 0.8 ms for a mobility of 2 $cm^2/V\cdot s$. The limit of detection of impurity concentration is about 1.3 ppb, indicating that concentration of water content from about 1 ppb to several tens ppb can be measured.

EMBODIMENT 3

FIG. 3 is a block diagram showing a construction of a third embodiment of the gas analyzer constructed according to the teachings of the present invention. The embodiment shown in FIG. 3 is particularly characterized in that purified gas 10 is introduced into ion source 5, while sample gas 1 is introduced into drift tube 16.

According to this embodiment, the residence time $t_0$ of the main component ions in ion source 5 should be controlled to be shorter than the mean reaction time $1/k'[Y]$ between ions $\{C+\}$ and the impurity Y in ion source 5. In order to separate the main component ions and the impurity ions, moreover, the drift time should be no shorter than a constant value (for example, about 0.3 ms), but the ion residence time $t_0$ and ion source 5 can be made shorter than the drift time. As a result, the present embodiment will be less effected by impurities remaining in purified gas 10 after passing through purifier 9 than is the case of Embodiment 1 above. Moreover, the relationship of $t_0[Y]/t_1<1$, i.e., $t_0<t_1$, must hold to achieve the detection lower limit of 1 ppb or less, and the relation of $100/t_1>100$, i.e., $t_1<1$ ms must also hold to set the measurable upper limit of 100 ppb or more.

EMBODIMENT 4

Figure 4:
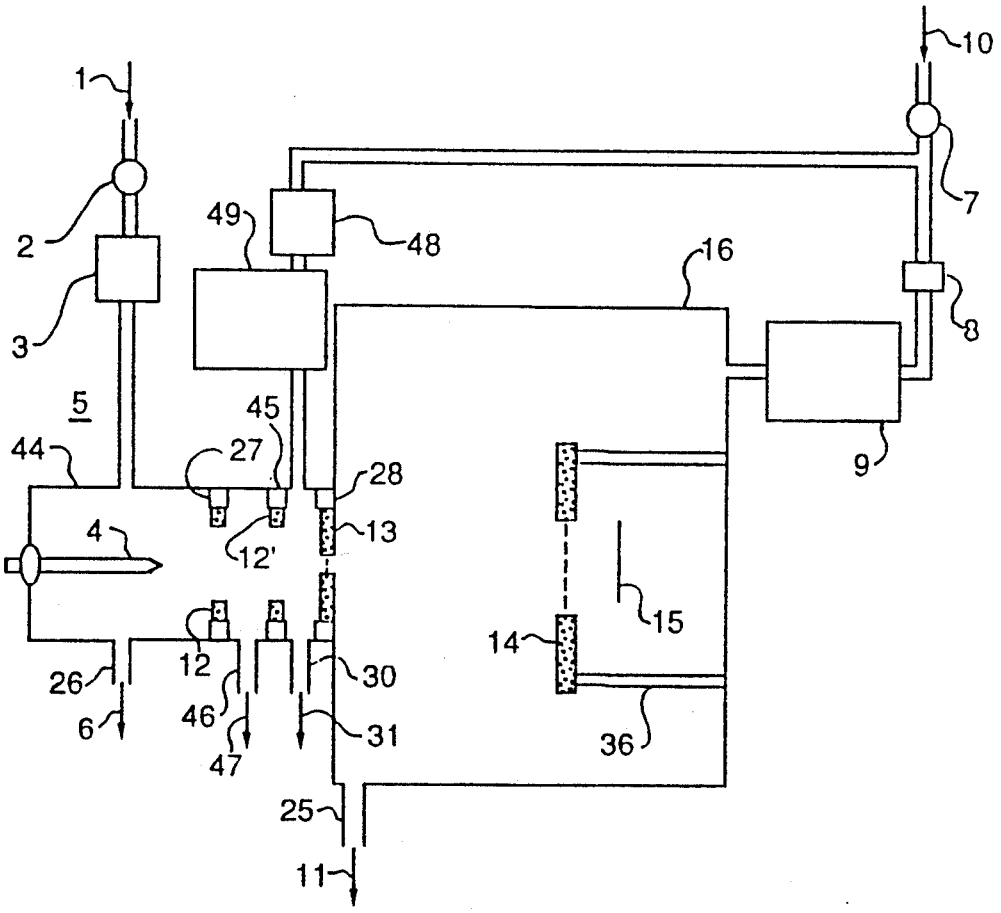
FIG. 4 is a block diagram showing the construction of a fourth embodiment of the gas analyzer according to the present invention.

FIG. 4 is a block diagram showing a further construction of the gas analyzer constructed according to the present invention. This fourth embodiment is characterized particularly by the addition of electrode 12' to the ion source 5, and in that chamber 44 comprises three chambers in connection with the direction of ion movement. The power source, linear motion feedthrough, detector, signal processor, etc., are omitted for simplicity of illustration; otherwise, the FIG. 4 embodiment is similar to the embodiment of FIG. 1.

In the first chamber, which is the greatest distance from the ion species separating means, needle electrode 4 is disposed so that sample gas 1 is introduced and ionized. The purified gas 10 is partially introduced through a flow controller 48 and a purifier 49 into the third chamber, defined as the chamber closest to the ion species separating means. Excess sample gas is discarded from outlet 26 of the first chamber, outlet 46 of the second chamber and outlet 30 of the third chamber. The gas purified through flow controller 48 and purifier 49 is introduced into drift tube 16, with the excess being discarded from outlet 25.

Although the measuring method of the present embodiment is identical to that of Embodiment 1, sample gas 1 can be prevented from flowing into drift tube 16 by the purifying gas 10, which is introduced into the third chamber. Thus, the drift gas in drift tube 16 can be prevented from losing purity, thus preventing the measurable lower limit of impurity in the sample gas 1 from rising.

EMBODIMENT 5

Figure 5:
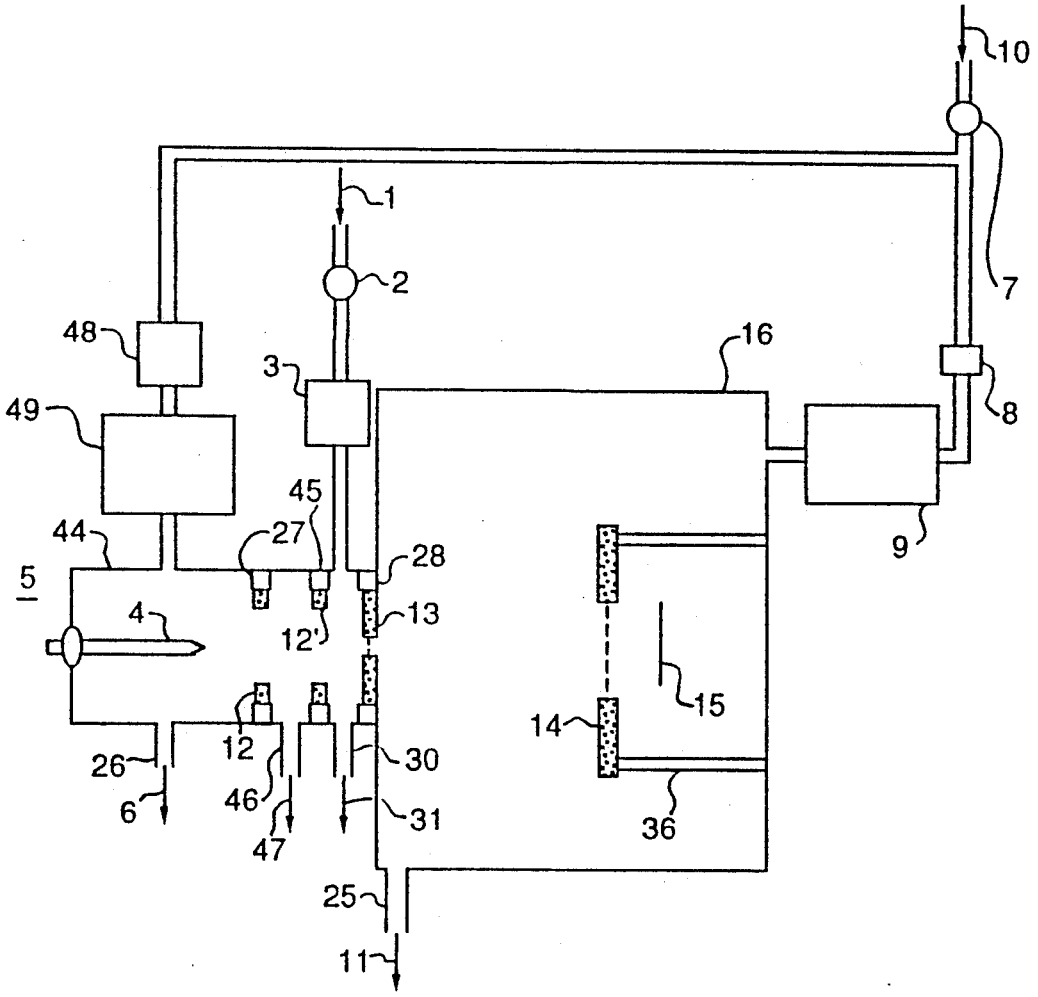
FIG. 5 is a block diagram showing the construction of a fifth embodiment of the gas analyzer according to the present invention.

FIG. 5 is a block diagram showing a construction of a fifth embodiment of a gas analyzer constructed according to the teachings of the present invention. Like the gas analyzer shown in FIG. 4, the power source, linear motion feedthrough, detector, signal processor, etc., have been omitted for simplicity of illustration.

The instant embodiment is directed to the case where the sample gas 1 is useful for generating solid state materials. For example, monosilane gas may be ionized and introduced into the third chamber between electrodes 12' and 13. The purified gas 10 is then introduced into the first chamber of chamber 44 and into the drift tube 16. Excess purified gas 6 is discarded through outlet 26, while excess sample gas 31 is discarded through outlet 30. A mixture of purified gas 10 and sample gas 1 is discarded at 11 from outlet 46.

The following example illustrates a case where the purified gas is hydrogen, and sample gas is monosilane, with water being the impurity of the monosilane gas to be analyzed.

Hydrogen ions $\{H_2+\}$ are produced by the ionization, and are converted within an extremely short time into $\{H_3+\}$ by reaction with hydrogen molecules. The ions $\{H_3+\}$ are introduced into the third chamber by the electric field, which is established by electrodes 12 and 12' and shutter 13, to produce main component ions $\{Si_2H_7+\}$ and water ions $\{SiH_3(H_2O)+\}$. These ions are separated in drift tube 16 to measure the water content in terms of the intensity of the ions $\{Si_2H_7+\}$. Since the ionization is not effected in the sample gas, according to this embodiment, no solid state material is produced, and the impurity analysis can be accomplished without concern for instability of the ion current or the deterioration of measuring accuracy, which might otherwise be caused by contamination in the ion source.

EMBODIMENT 6

Figure 6:
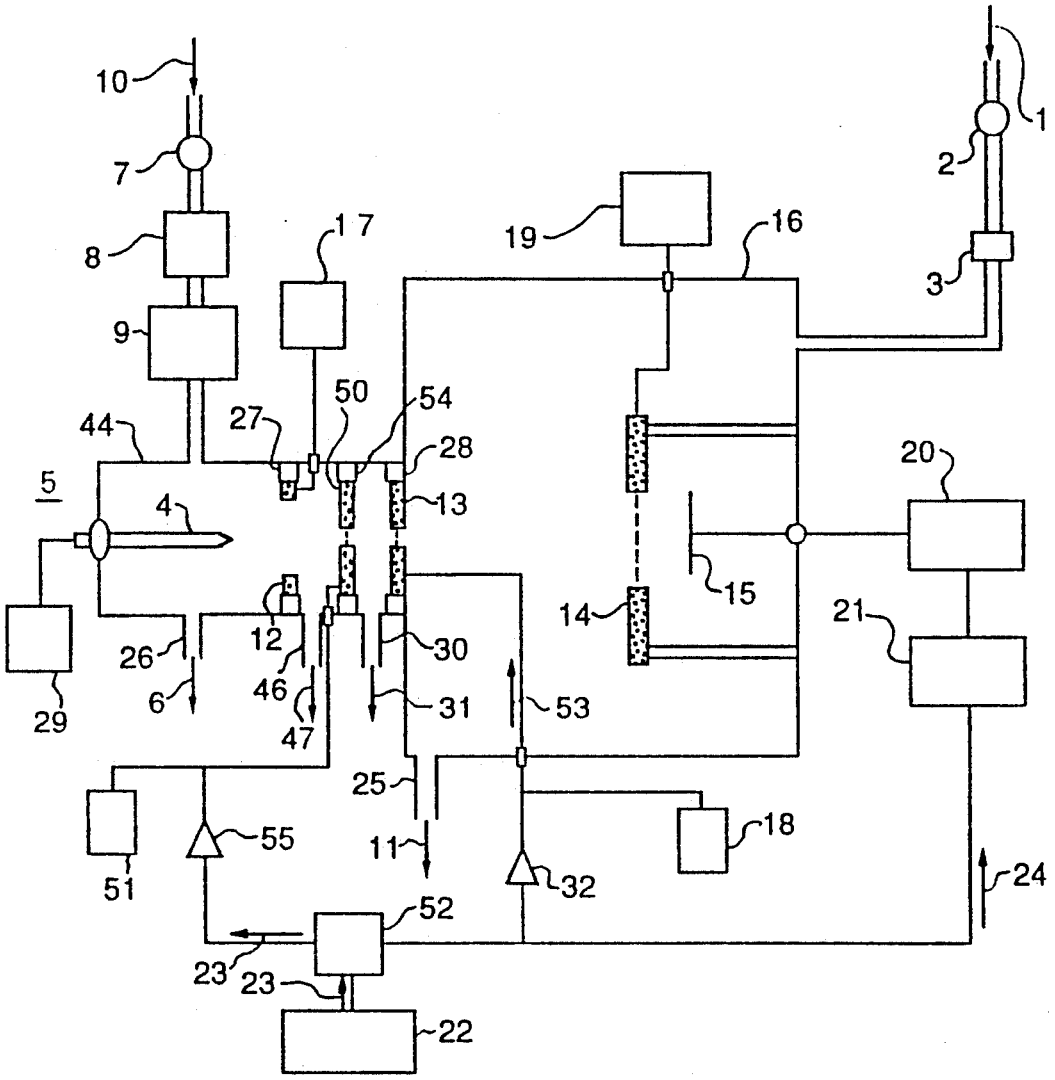
FIG. 6 is a block diagram showing the construction of a sixth embodiment of the gas analyzer according to the present invention.

FIG. 6 is a block diagram showing a construction of a sixth embodiment of a gas analyzer constructed in accordance with the teachings of the present invention. This embodiment is particularly characterized, as compared with the embodiment of FIG. 3, in that a shutter 50 is added to the ion source 5, and in that the ion source 5 has its chamber divided into three subchambers.

In ion source 5, main component ions are produced and react with the impurity residing in the purified gas 10 so that impurity ions are also produced. These impurity ions invite a drop in the detecting sensitivity. By operating the third chamber as the drift tube 16, therefore, a means for eliminating the impurity ions is provided.

Specifically, after shutter 50 has been opened for a short time, shutter 13 is also opened for a short time after a predetermined delay. This time delay is controlled by pulse delay means 52 to introduce the ions of a main component selectively into the drift region for analysis. According to this embodiment, the impurity ions present in the ion source 5 are eliminated, and only the process of reducing the amount of the main component ions in the drift region as a result of reaction with the impurity molecules is observed to prevent the drop of detecting sensitivity.

EMBODIMENT 7

Figure 9:
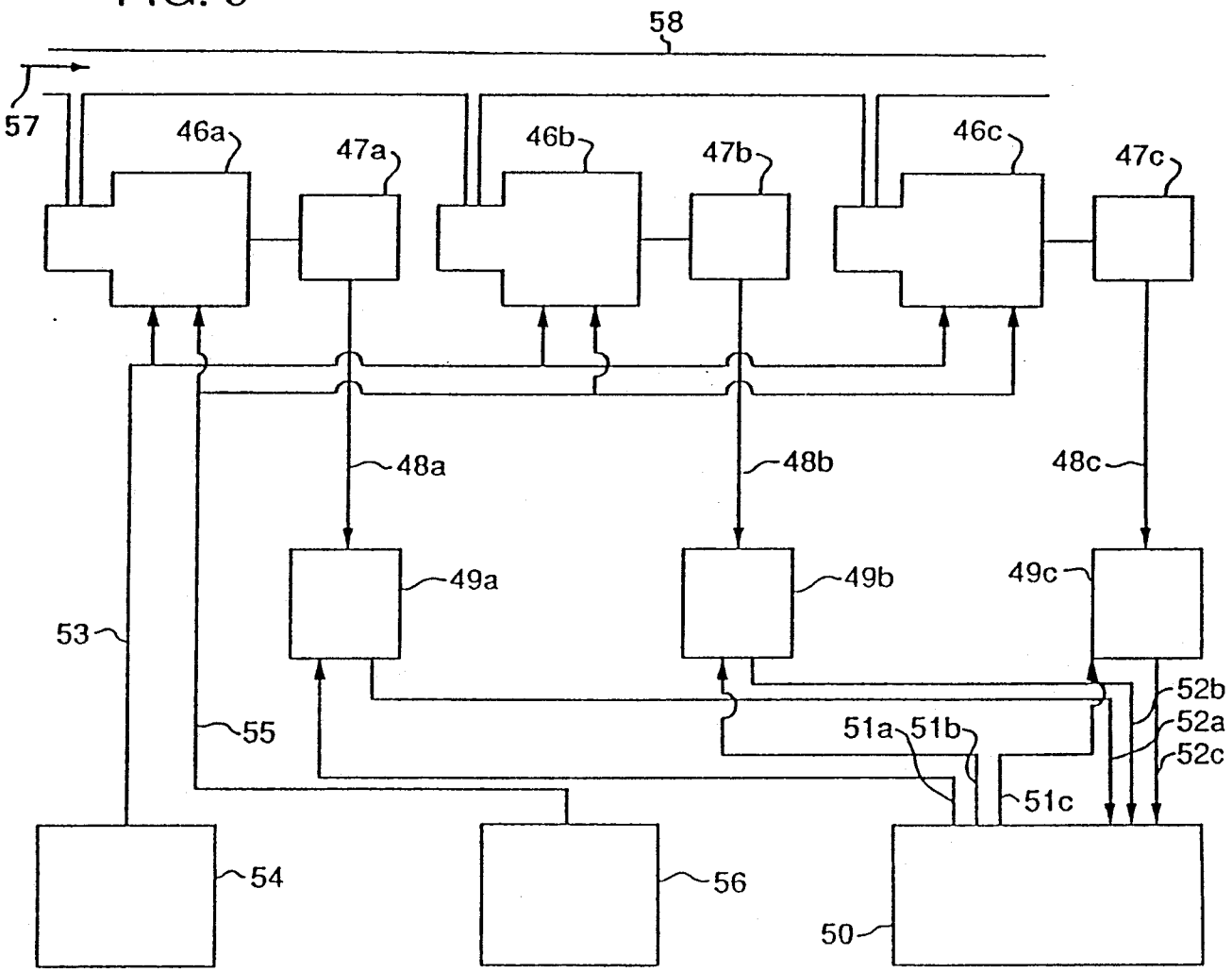
FIG. 9 is a block diagram of a gas analysis system incorporating a single computer control and a single gas delivery system for a plurality of gas analyzers constructed according to one of the embodiments of the present invention.

In a seventh embodiment, a plurality of gas analyzers are provided with a single gas delivery system as shown in FIG. 9. In accordance with this embodiment, control of the gas delivery system is carried out by a single computer and a single power supply for the multiple gas analyzers.

In accordance with this embodiment, at least two gas analyzers are used for monitoring the purity of a sample gas flowing in the gas delivery system. FIG. 9 shows a particular, though exemplary, embodiment using three gas analyzers **46*a*, 46*b* and 46*c*, which monitor the purity of sample gas 57 flowing through gas delivery system 58. Gas analyzers 46*a*, 46*b***, etc., may take the form of any of the embodiments set forth in the foregoing description.

The plurality of gas analyzers **46*a*, 46*b*, etc., share a single pulse generator 54, a single high voltage power supply 56, and a computer 50 for data processing and for controlling the gas analyzers. By way of presenting a more thorough discussion of the embodiment, A/D converters 47***a*, 47*b* and 47*c* convert analog information output by their respective gas analyzers 46*a*, 46*b* and 46*c* and to digital data 48*a*, 48*b* and 48*c*, which are delivered to respective memory devices 49*a*, 49*b* and 49*c*.

In accordance with control signals 51*a*, 51*b* and 51*c* output from computer 50 to the respective memory devices 49*a*, 49*b* and 49*c*, storage data 52*a*, 52*b* and 52*c* are retrieved from memory devices 49*a*, 49*b* and 49*c*, and delivered to computer 50 for analysis. The analysis performed by computer 50, for example, includes any of the processes set forth in the foregoing description for determining the impurity concentration of any of a variety of impurities found in the sample gas 57.

Rounding out the system shown schematically in FIG. 9 is shutter operation signal 53, which is output by pulse generator 54 to perform the open and close operations for shutter 13 in each embodiment (and shutter 50 in embodiment 6). Thus, in accordance with this seventh embodiment, a plurality of gas analyzers can be incorporated in a small-sized and highly sensitive system for determining the concentrations of various impurities having ultra-low levels (e.g., on the ppb order) in a highly-purified gas to be used in a clean room for the production of semiconductor devices, for example, using a common gas delivery system and common computer control.

Although the present invention has been described in connection with a number of embodiments for analyzing an impurity (such as water) in a sample gas (such as nitrogen), the invention is not limited to the specific embodiments, but can be applied to any sample gas that will experience an irreversible ion-molecule reaction between main component ions and impurity molecules. As such, various modifications of the invention will become apparent to those of ordinary skill in the art and all such modifications that basically rely upon the teachings through which the present invention has advanced the state of the art are properly considered within the spirit and scope of the invention.

We claim:

1. A gas analyzer, comprising:

an ion source having a first chamber for containing a sample gas having main component molecules and impurity molecules;

means for ionizing the sample gas in the first chamber to produce main component ions from the main component molecules;

ion species separating means, having a second chamber, for drifting and separating the main component ions of said sample gas from impurity ions formed by reactions between the impurity molecules and the main component ions; and signal processing means for analyzing the impurity concentration of the sample gas, including means for detecting the main component ions and the impurity ions, and for controlling the residence time of the main component ions in said second chamber to be shorter than the mean reaction time of the main component ions with the impurity molecules in the second chamber.

2. A gas analyzer as claimed in claim 1, wherein said ion source further includes means for changing the residence time of the main component ions in the first chamber in accordance with a signal received from said signal processing means.

3. A gas analyzer as claimed in claim 2, wherein the ion species separating means further includes means for changing the residence time of the main component ions in the second chamber in accordance with a signal received from said signal processing means.

4. A gas analyzer as claimed in claim 1, wherein the ion species separating means further includes means for changing the residence time of the main component ions in the second chamber in accordance with a signal received from said signal processing means.

5. A gas analyzer as claimed in claim 1, wherein the first chamber comprises first, second and third subchambers, the first subchamber being the greatest distance from the ion species separating means with respect to the second and third chambers, the third subchamber being the shortest distance from the ion species separating means with respect to the first and second subchambers, and wherein the first subchamber includes the ionization means and an inlet port through which the sample gas is introduced, and wherein the third subchamber includes an inlet for introducing a portion of a carrier gas.

6. A gas analyzer as claimed in claim 1, wherein the first chamber comprises first, second and third subchambers, the first subchamber being the greatest distance from the ion species separating means with respect to the second and third chambers, the third subchamber being the shortest distance from the ion species separating means with respect to the first and second subchambers, and wherein the first subchamber includes the ionization means and an inlet port through which a portion of a carrier gas is introduced, and wherein the third subchamber includes an inlet for introducing the sample gas.

7. A gas analyzer, comprising:

an ion source including a first chamber for containing a carrier gas;

means for ionizing the carrier gas in the first chamber;

ion species separating means including a second chamber for containing the ionized carrier gas and a sample gas having impurity molecules, and means for drifting and separating main component ions of the ionized carrier gas from impurity ions, said impurity ions being produced by a reaction between the main component ions and impurity molecules in the sample gas; and signal processing means for detecting and analyzing the main component ions and the impurity ions, and for controlling the residence time of the main component ions in the first chamber to be shorter than the time required for the reaction between the main component ions and the impurity molecules in the first chamber.

8. A gas analyzer as claimed in claim 7, wherein said ion source further includes means for changing the residence time of the main component ions in the first chamber in accordance with a signal received from said signal processing means.

9. A gas analyzer as claimed in claim 8, wherein the ion species separating means further includes means for changing the residence time of the main component ions in the second chamber in accordance with a signal received from said signal processing means.

10. A gas analyzer as claimed in claim 7 wherein the ion species separating means further includes means for changing the residence time of the main component ions in the second chamber in accordance with a signal received from said signal processing means.

11. A gas analyzer as claimed in claim 10, wherein the drifting means includes a first electrode and a detector, and means for controlling the potential between the detector and the first electrode to drive the main component ions and the impurity ions.

12. A gas analyzer as claimed in claim 11, wherein the residence time-changing means further includes means for varying the distance between the first electrode and the detector.

13. A gas analyzer as claimed in claim 8, wherein the residence time-changing means of the ion source further includes a first electrode and a shutter that are relatively spaced to form a region therebetween, and means for varying the potential difference between the shutter and the first electrode to drive the main component ions.

14. A gas analyzer as claimed in claim 13, wherein the residence time-changing means further includes means for varying the distance between the first electrode and the shutter.

15. A gas analyzer as claimed in claim 14, wherein the shutter and the first electrode each include an aperture for passing the main component ions.

16. A gas analyzer as claimed in claim 15, wherein the shutter spatially isolates the first and second chambers from each other to reduce mixing of the sample gas and the carrier gas.

17. A gas analyzer as claimed in claim 16, wherein the carrier gas includes a main component that will react with neither a main component of the sample gas nor the impurity molecules of the sample gas.

18. A gas analyzer as claimed in claim 7, wherein the ionization means includes means for producing ions by corona discharge.

19. A gas analysis system, comprising:

first and second gas analyzers each including an ion source having a first chamber for containing a sample gas having main component molecules and impurity molecules; means for ionizing the sample gas in the first chamber to produce main component ions from the main component molecules; ion species separating means, having a second chamber, for drifting and separating the main component ions of said sample gas from impurity ions formed by reactions between the impurity molecules and the main component ions; and signal processing means for analyzing the impurity concentration of the sample gas, including means for detecting the main component ions and the impurity ions, and means for controlling the residence time of the main component ions in said second chamber to be shorter than the mean reaction time of the main component ions with the impurity molecules in the second chamber;

a single computer for analyzing data received from the gas analyzers concerning the concentration of main component ions and impurity ions; and a common gas delivery system for delivering sample gas to each of the gas analyzers.

20. A gas analysis system, comprising:

first and second gas analyzers each including an ion source including a first chamber for containing a carrier gas; means for ionizing the carrier gas in the first chamber; ion species separating means including a second chamber for containing the ionized carrier gas and a sample gas having impurity molecules, and means for drifting and separating main component ions of the ionized carrier gas from impurity ions, said impurity ions being produced by a reaction between the main component ions and impurity molecules in the sample gas; and signal processing means for detecting and analyzing the main component ions and the impurity ions, including means for controlling the residence time of the main component ions in the first chamber to be shorter than the time required for the reaction between the main component ions and the impurity molecules in the first chamber;

a single computer for analyzing data received from the gas analyzers concerning the concentration of main component ions and impurity ions; and a common gas delivery system for delivering sample gas to each of the gas analyzers.

21. A method for analyzing the impurity concentration of a sample gas, comprising the steps of:

introducing a sample gas into an ion source chamber;

ionizing the sample gas in the ion source chamber to produce main component ions from main component molecules of the sample gas;

in a drift chamber, drifting and separating the main component ions of the sample gas from impurity ions formed by reactions between impurity molecules of the sample gas and the main component ions;

controlling the residence time of the main component ions in the drift chamber to be shorter than the mean reaction time of the main component ions with the impurity molecules in the drift chamber;

detecting the main component ions and the impurity ions; and analyzing the impurity concentration of the sample gas.

22. A method for analyzing an impurity concentration of a gas, comprising the steps of:

introducing a carrier gas into an ion source chamber;

ionizing the carrier gas in the ion source chamber;

introducing a sample gas having impurity molecules into a drift chamber;

drifting and separating main component ions of the ionized carrier gas from impurity ions of the sample gas, said impurity ions being produced by a reaction between the main component ions and the impurity molecules of the sample ga;

controlling the residence time of the main component ions in the ion source chamber to be shorter than the time required for the reaction between the main component ions and the impurity molecules in the ion source chamber;

detecting the main component ions and the impurity ions in the drift chamber; and analyzing the impurity concentration of the sample gas.

* * * * *